US012435941B2

(12) United States Patent
Wiese

(10) Patent No.: US 12,435,941 B2
(45) Date of Patent: Oct. 7, 2025

(54) TRIGGER ASSEMBLY AND METHOD OF CALIBRATING AND ADJUSTING A PULL FORCE ON A TRIGGER

(71) Applicant: Black Talon Tactical LLC, Brooklyn Park, MN (US)

(72) Inventor: David Wiese, Brooklyn Park, MN (US)

(73) Assignee: Black Talon Tactical LLC

( * ) Notice: Subject to any disclaimer, the term of this patent is extended or adjusted under 35 U.S.C. 154(b) by 0 days.

(21) Appl. No.: 18/414,433

(22) Filed: Jan. 16, 2024

(65) Prior Publication Data

US 2024/0240895 A1 Jul. 18, 2024

Related U.S. Application Data

(60) Provisional application No. 63/479,888, filed on Jan. 13, 2023.

(51) Int. Cl.
*F41A 19/16* (2006.01)

(52) U.S. Cl.
CPC ..... *F41A 19/16* (2013.01)

(58) Field of Classification Search
CPC ..... F41A 19/16; F41A 19/17; F41A 19/15
USPC ..... 42/69.01, 69.03
See application file for complete search history.

(56) References Cited

U.S. PATENT DOCUMENTS

| | | | | |
|---|---|---|---|---|
| 2,126,076 | A * | 8/1938 | Wright | F41A 19/16 42/69.02 |
| 5,487,233 | A * | 1/1996 | Jewell | F41A 19/16 42/69.01 |
| 9,927,198 | B2 | 3/2018 | Geissele | |
| 10,295,286 | B1 | 5/2019 | Withey | |
| 11,029,116 | B2 * | 6/2021 | Biegel | F41A 19/10 |
| 11,635,270 | B2 * | 4/2023 | Dextraze | F41A 19/12 42/69.01 |
| 11,815,323 | B2 | 11/2023 | Kolev et al. | |
| 2023/0113214 | A1 * | 4/2023 | Roessel | F41A 19/10 42/69.01 |

* cited by examiner

*Primary Examiner* — Reginald S Tillman, Jr.
(74) *Attorney, Agent, or Firm* — Gutwein Law; Tyler B. Droste

(57) ABSTRACT

A trigger assembly and associated method for use for the adjustment of trigger pull force of a firearm. The trigger assembly having a housing with an adjustment means in the form of a fastener in communication with one or more trigger springs that interface with a trigger. The adjustment means can be configured to adjust a length of one or more trigger springs to adjust the trigger pull force of the trigger assembly. A calibrated force tester can be coupled to a portion of the trigger to test the amount of trigger pull force necessary to release a hammer of the trigger assembly. The trigger assembly enables a calibrated repeatable method of giving a user the ability to adjust the trigger system pull force by the means of a calibrated laser etched scale on the trigger housing that works in conjunction with the adjustment means.

16 Claims, 7 Drawing Sheets

TRIGGER ASSEMBLY AND METHOD OF CALIBRATING AND ADJUSTING A PULL FORCE ON A TRIGGER

CROSS-REFERENCE

This patent application claims priority to U.S. Provisional Application 63/479,888 filed Jan. 13, 2023, the disclosure of which is considered part of the disclosure of this application and is hereby incorporated by reference in its entirety.

FIELD OF THE INVENTION

The invention relates generally to an improved trigger assembly and method for use. More particularly, for a fixed or adjustable pull force trigger, a specialized adjustment fastener is attached to a housing of the trigger in coupling with the trigger in order to vary the length of a trigger spring or springs while the trigger is fixed to a calibrated force tester.

BACKGROUND

All currently available trigger systems for AR Platform firearms whether fixed pull force or adjustable pull force utilize a number of springs that perform various tasks within the trigger assembly. One of those tasks is providing resistance to the trigger (pull force) so that when the operator pulls the trigger, there is a measure of resistance against the operators finger prior to the firearm releasing its hammer and thereby igniting the cartridge to fire the firearm. It is well known in the field of manufacturing that multiple different variables affect the pull force of a trigger system. Some of these variables include but are not limited to: Trigger/Hammer interaction distance, the surface finish of the trigger/hammer interface, the geometry of the trigger/hammer and most importantly the manufacturing tolerances of the trigger spring and hammer spring. In the real world it is very difficult, expensive and time consuming to control any one of these variables, let alone all of them so it is virtually impossible to build a trigger system that has a consistent pull force from one to the other. Quite often that variance in pull force is 8 oz or more (from published data).

For known adjustable pull force trigger systems currently within the prior art, a combination of a screw mechanism and springs is utilized to adjust the pull force of the trigger, but no currently available adjustable trigger systems have a method of repeating the adjustment with any type of accuracy. The major drawback of this system is two-fold; first, once the adjustment screw mechanism has been moved from its initial position, it is impossible to know exactly (within 1 oz) what the trigger pull force is set to. It becomes a guessing game and unless the trigger user has an accurate (within 1 oz) repeatable pull force tester, the user will never know what the actual pull force of their trigger was. Second, once the adjustment screw mechanism has been moved from its initial position it is impossible to return to that initial position with any sort of accuracy. In other words, even if the manufacturer states that their adjustable trigger system is initially calibrated to a specific pull force, since no currently available trigger systems have a clear indicator where they were initially calibrated, it is impossible to return to that initial pull force with any type of accuracy.

Therefore, based upon these drawbacks, an improved trigger system and method of use is desired to ensure that the desired trigger pull force is accurate, repeatable, and capable of being placed in a fixed position or adjustable between specific set points indicated on the housing of the trigger assembly.

BRIEF SUMMARY OF THE INVENTION

The present disclosure relates to a trigger assembly and associated method for use for the adjustment of trigger pull force of an AR platform firearm. The trigger assembly having a housing with an adjustment means in the form of a screw-like fastener in communication with a trigger spring(s) and configured to adjust a length of the trigger spring(s) while the trigger is fixed to a calibrated force tester. In an alternate embodiment, the trigger assembly enables a calibrated repeatable method of giving the user the ability to adjust the trigger systems pull force by the means of a calibrated laser etched scale on the trigger housing that works in conjunction with an adjustment screw mechanism with a fixed pitch and a spring or springs that have a fixed spring rate or rates.

In yet another aspect, the present disclosure relates to an improved trigger assembly apparatus including a housing portion, a trigger, and a first spring. A housing portion can be configured to be easily inserted into a receiver of a firearm. The housing portion can have a first sidewall, a second sidewall, and a bottom wall, wherein a cavity is formed within the first sidewall, second sidewall, and bottom wall. The bottom wall can include a first aperture and a second aperture, wherein the second aperture can be configured to accept an adjustment fastener. A trigger can have a first portion and a second portion. The first portion of the trigger can be positioned and received primarily within the cavity of the housing and a second portion of the trigger portion can extend out of the first aperture on the bottom wall of the housing portion, the trigger can be pivotably coupled to the housing. A first portion of the trigger can further include an adjustment cavity or engagement portion. A first spring can be partially housed within the adjustment cavity of the trigger. The adjustment fastener can be configured to adjust the compressive force exerted onto the adjustment cavity of the trigger. The adjustment fastener can be moved from a first position to exert a first compressive force to a second position to exert a second compressive force against the adjustment cavity of the trigger. The compressive force of the spring can correlate to a prescribed pull force of the trigger to release a hammer of the assembly.

In yet another aspect, the present disclosure relates to a method for adjusting the trigger pull force of a given firearm. A trigger assembly having a housing and an adjustment fastener accessible on a bottom surface of the housing can be provided. An adjustment spring can be included in the trigger assembly and be in contact with a portion of a trigger of the trigger assembly. The first spring can exert a first spring force against a portion of the trigger. The spring force exerted by the adjustment spring can be adjusted by turning the adjustment fastener without removing the adjustment spring.

The invention now will be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

DETAILED DESCRIPTION OF THE INVENTION

Figure 1:
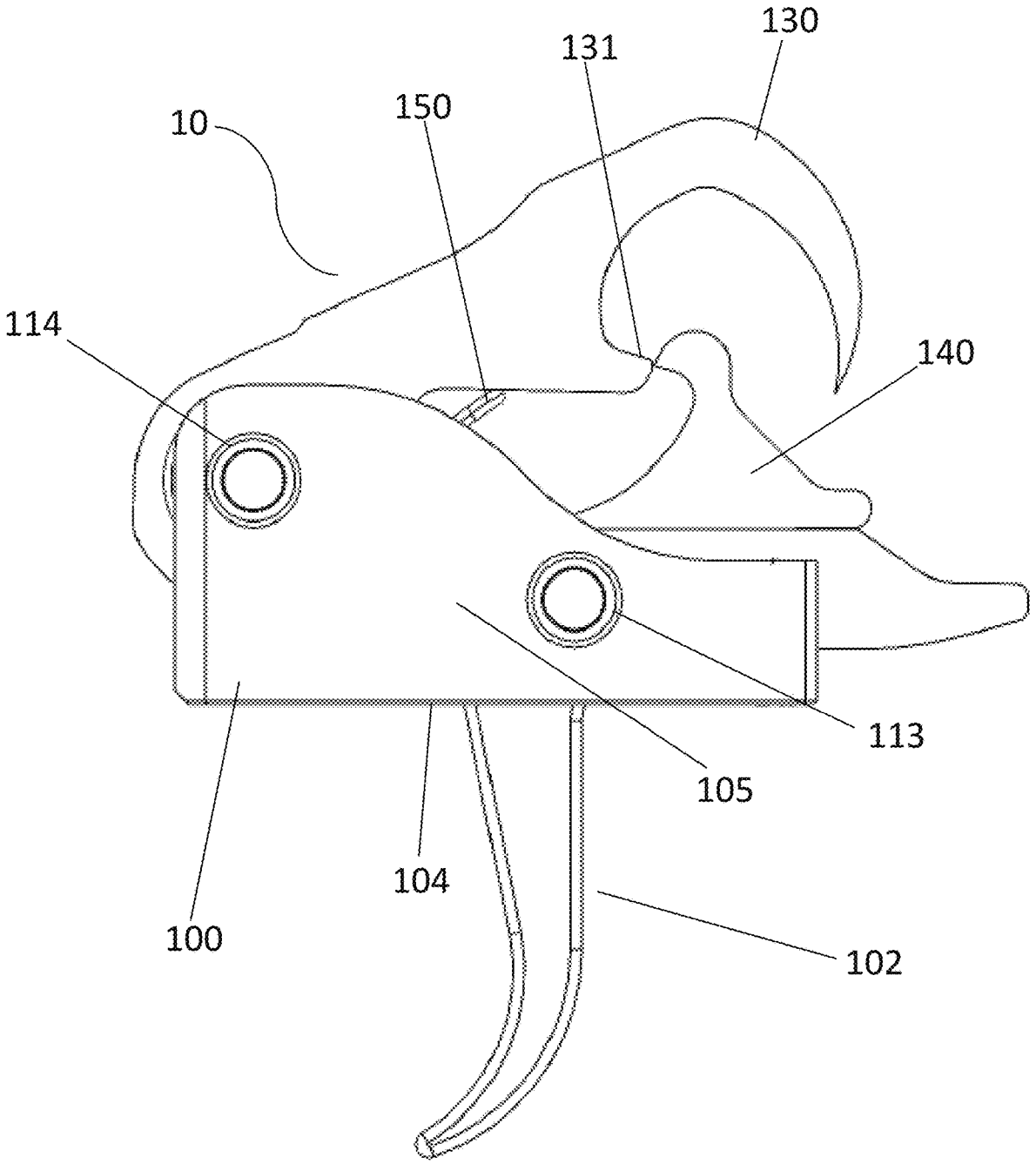
FIG. 1 is a side view of an exemplary embodiment of an improved trigger housing apparatus according to the present disclosure.

The following detailed description includes references to the accompanying images, which forms a part of the detailed description. The images show, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, and logical changes may be made without departing from the scope of the present invention. The following detailed description is, therefore, not to be taken in a limiting sense.

Before the present invention of this disclosure is described in such detail, however, it is to be understood that this invention is not limited to particular variations set forth and may, of course, vary. Various changes may be made to the invention described and equivalents may be substituted without departing from the true spirit and scope of the invention. In addition, many modifications may be made to adapt a particular situation, material, composition of matter, process, process act(s) or step(s), to the objective(s), spirit, or scope of the present invention. All such modifications are intended to be within the scope of the disclosure made herein.

Unless otherwise indicated, the words and phrases presented in this document have their ordinary meanings to one of skill in the art. Such ordinary meanings can be obtained by reference to their use in the art and by reference to general and scientific dictionaries.

References in the specification to "one embodiment" indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following explanations of certain terms are meant to be illustrative rather than exhaustive. These terms have their ordinary meanings given by usage in the art and in addition include the following explanations.

As used herein, the term "and/or" refers to any one of the items, any combination of the items, or all of the items with which this term is associated.

As used herein, the singular forms "a," "an," and "the" include plural reference unless the context clearly dictates otherwise.

As used herein, the terms "include," "for example," "such as," and the like are used illustratively and are not intended to limit the present invention.

As used herein, the terms "preferred" and "preferably" refer to embodiments of the invention that may afford certain benefits, under certain circumstances. However, other embodiments may also be preferred, under the same or other circumstances.

Furthermore, the recitation of one or more preferred embodiments does not imply that other embodiments are not useful and is not intended to exclude other embodiments from the scope of the invention.

As used herein, the terms "front," "back," "rear," "upper," "lower," "right," and "left" in this description are merely used to identify the various elements as they are oriented in the FIGS, with "front," "back," and "rear" being relative to the apparatus. These terms are not meant to limit the elements that they describe, as the various elements may be oriented differently in various applications.

As used herein, the term "coupled" means the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature. Similarly, coupled can refer to a two member or elements being in communicatively coupled, wherein the two elements may be electronically, through various means, such as a metallic wire, wireless network, optical fiber, or other medium and methods.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element without departing from the teachings of the disclosure.

Figure 2:
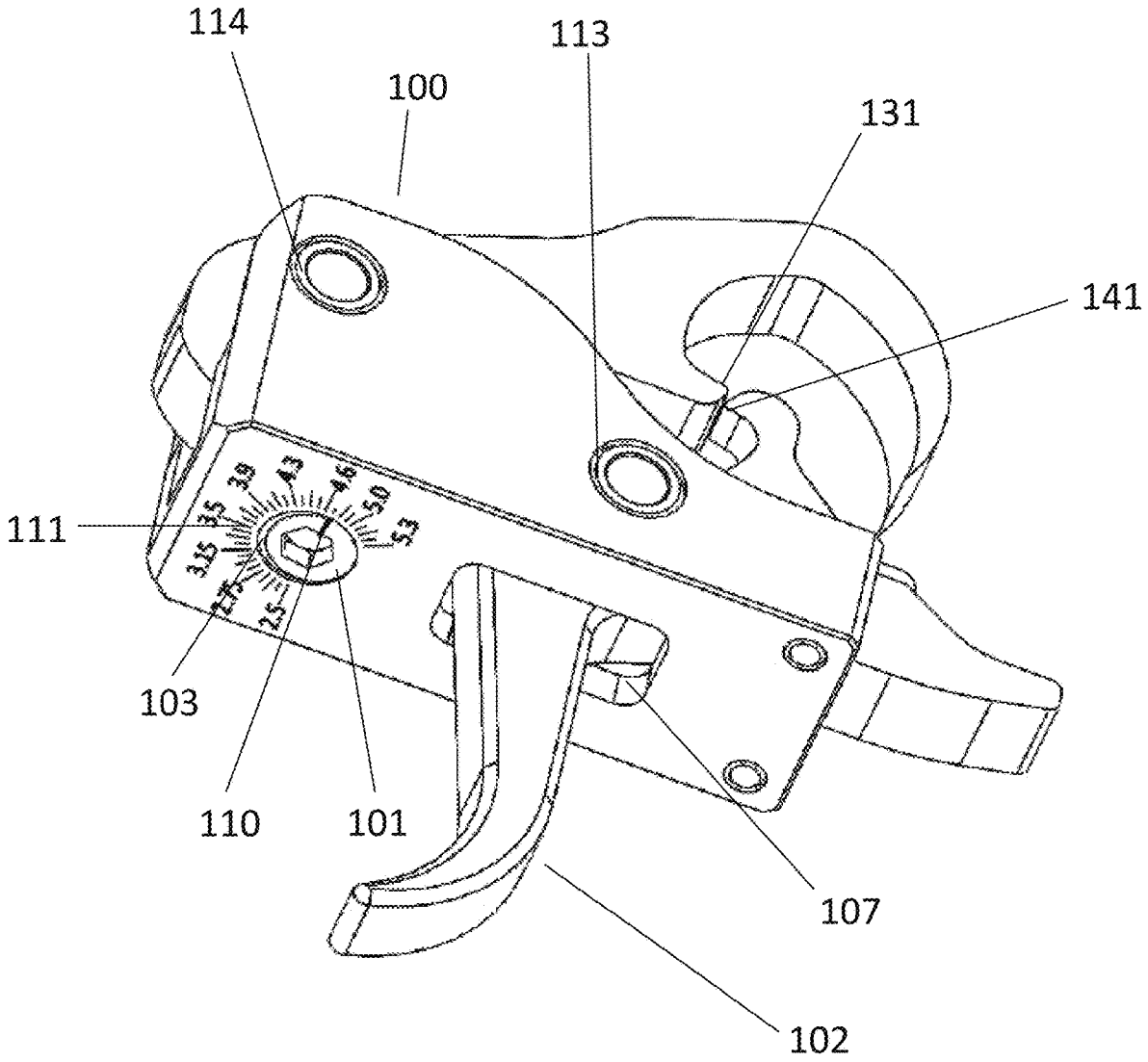
FIG. 2 is a bottom isometric view of an exemplary embodiment of an improved trigger assembly apparatus according to the present disclosure.

Referring now to FIGS. 1-2 of the invention can most generally be described as an improved trigger assembly 10 having a housing 100 with an adjustment mechanism communicatively coupling or interfacing at least one trigger biasing means 120, including but not limited to a trigger spring, for enabling calibration and adjustment of a pull force of a trigger 102 within the housing 100. A trigger assembly 10 and method of use with the trigger assembly 10 generally referred to herein as apparatus 10 of the present disclosure. The apparatus 10 can generally be configured to provide a means to enable a calibration of a given trigger pull force for a firearm, such as, but not limited to, an AR Platform rifle. The assembly can be easily coupled to an AR bottom receiver or other firearm platform.

More particularly, the apparatus 10 can enable a user to utilize a fixed or adjustable pull force trigger portion 102 that can be calibrated to a repeatable trigger pull force. In some exemplary embodiments the repeatable trigger full force can be achieved within about 1 oz of a desired pull force. A fixed or adjustable pull force trigger 102 can be accomplished by utilizing a special adjustment fastener 101 attached to a housing portion 100 and in communication with a trigger portion 102 in order to vary a length of the trigger spring or springs while the trigger portion 102 is fixed to a calibrated force testing apparatus. The adjustment fastener 101 can utilize and suitable means for adjustment including but not limited to a driver or wrench, including but not limited to a hex head wrench to turn the fastener 101 thereby adjusting the spring tension and pull force necessary to actuate the trigger 102 and release the hammer 130. In some exemplary embodiments, the adjustment fastener 101 can have a threaded exterior sidewall and be coupled to an adjustment aperture that can have a corresponding threaded sidewall.

A trigger assembly 10 of the present disclosure can include a hammer 130, a disconnector or disconnect portion 140, and a hammer biasing means 150. The hammer 130 can have a first interfacing end 131 that can interface with a first interfacing end 141 of the disconnect portion 140. In some exemplary embodiment, the hammer biasing means 150 can be a hammer spring. The hammer spring can bias the hammer 130 around the assembly pin 129*b* passing through the hammer aperture 134. Additionally, a disconnect biasing means 153, including but not limited to a spring to allow the disconnect portion to bias between positions.

The housing portion 100 can generally have a first side 105, a second side 106, top side, and bottom side or surface 104. The top side can generally be open to access a cavity within the housing portion. The bottom surface 104 of the housing portion 100 can have a first aperture 107 configured to allow a portion 109 of the trigger 102 to extend through the aperture and be accessible through the bottom surface 104 of the housing 100 as shown in FIG. 2. A second aperture or adjustment aperture 103 can be configured to accept an adjustment means, including but not limited to an adjustment fastener 101. Each of the first side 105 and second side 106 of the housing can have corresponding first apertures 113 and a second apertures 114 configured to accept a corresponding pin or fastener. The first aperture 113 can be used to removably couple the hammer portion 130 to the housing and the second aperture 114 can be used to couple the trigger 102 and disconnect portion 140 to the housing 100.

In one exemplary embodiment of the present disclosure, the adjustment fastener 101 can be a screw having predetermined fixed pitch corresponding to one or more trigger biasing means including but not limited to spring or springs that have a fixed spring rate or rates. An adjustment fastener 101 can be couple to the aperture 103 of the housing 100 is a threaded bore having a specific size, shape, and pitch corresponding for the receipt of the fastener 101, wherein the sidewall of the aperture 103 has threading that corresponds to the threading on the sidewall of a fastener 101. The adjustment aperture 103 can be positioned generally in alignment with one re more trigger springs, wherein the fastener 101 can be coupled to or interface with one or more trigger springs 20 for generally manipulating a length of the trigger spring and the pull weight of the trigger 102 by a user. The adjustment aperture 103 can additionally align with an engagement portion of adjustment spring cavity 117 of the trigger 102.

Figure 3:
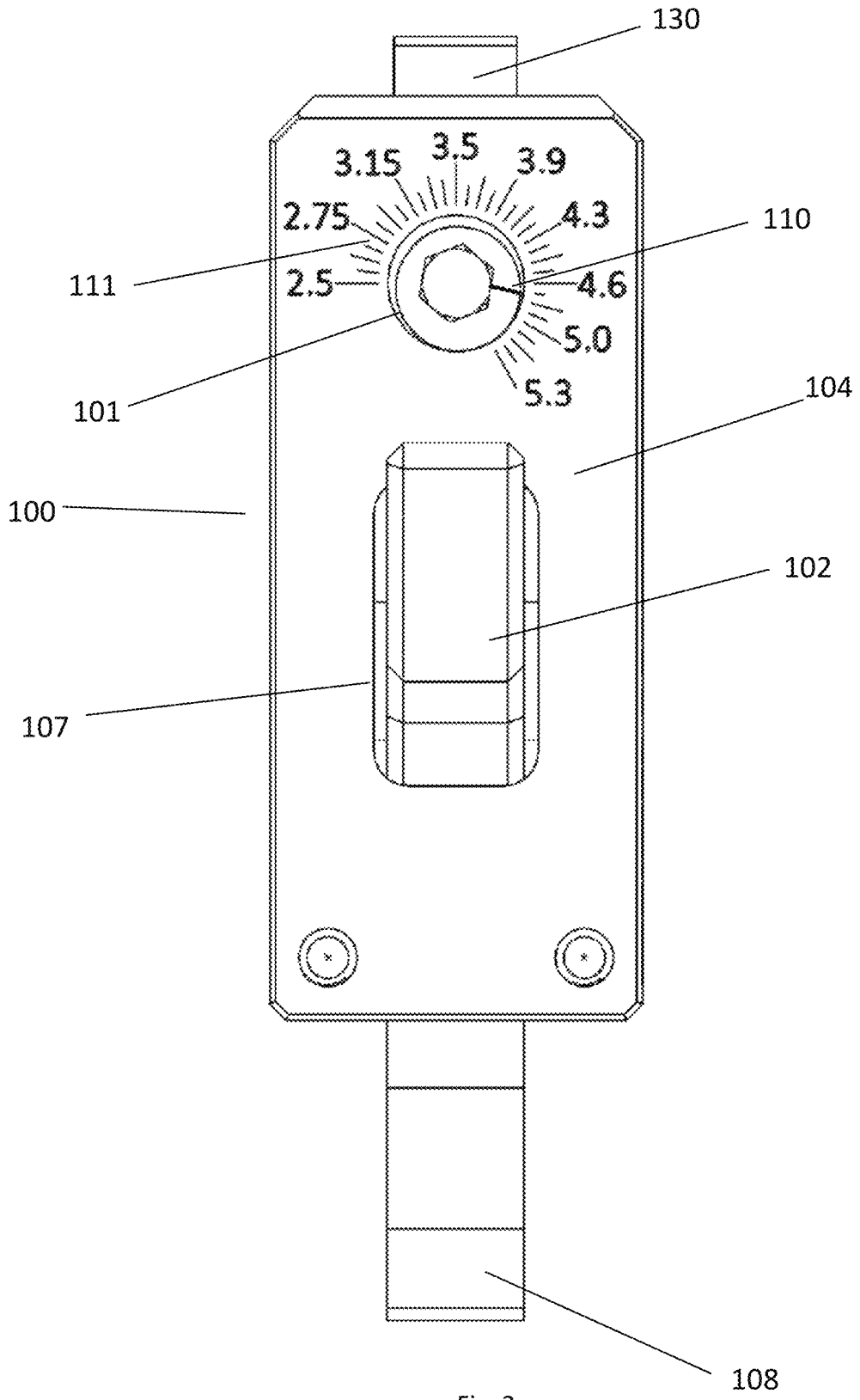
FIG. 3 is a bottom view of an exemplary embodiment of an improved trigger assembly apparatus according to the present disclosure.

For a fixed pull force trigger 102 once the trigger assembly apparatus 10 has been calibrated within about 1 oz to the desired trigger pull force, the adjustment fastener 101 that was used to calibrate the pull force can be permanently locked in place and modified so it can never change position or pull force. For an adjustable pull force trigger 102 the adjustment fastener 101 can be etched or marked with an indicator line 110 showing exactly what the initial calibrated pull force of the trigger is relative to a scale indicators 111 positioned on the bottom surface 104 of the housing 100 surrounding the adjustment aperture 103 and preferably surrounding the adjustment fastener 101 as shown in FIG. 3. The indicator line 110 can generally be formed on a top surface of the adjustment fastener 101. The scale indicators 111 can be standard measurement adjustments to allow a user to adjust the spring tension of the trigger at a granular rate. The numbers are for illustration purposes only and can be any suitable scale.

In some exemplary embodiments, the scale 111 can be laser etched directly into the housing 100 and provided in a plurality of graduation lines having a precision of about 0.2 micrometers (80 millionths of an inch) and when both the pitch of the adjustment screw and the spring rate(s) of the spring(s) are fixed and cannot change the apparatus 10 and associated method of use provides the user the ability to repeatedly adjust the trigger system with 1 oz accuracy.

The method of use of the apparatus 10 generally includes installation of the trigger housing 100 onto an applicable firearm. For a given firearm type, the housing 100 will have at least an adjustment aperture 103 generally aligned with the position of the trigger spring or trigger springs coupled to or interfacing with the trigger 102, wherein the adjustment aperture 103 can generally be utilized as an aperture to access the trigger spring or springs for manipulation of a length or tension of the trigger spring or springs and trigger 102 pull force. The fastener 101 is generally received within the adjustment aperture 103 in a coupling or interfacing with the at least a trigger spring or springs for fine adjustment of the trigger spring length or tension. The fastener can similarly be removed to replace damaged springs or to utilize springs with different compression rates. The trigger 102 pull force can then be calibrated through the use of external apparatus in the form of calibrated force tester. During this calibration process, the fastener 101 can be manipulated to adjust the tension and trigger 102 pull force. The pull force can then be set and fixed by a user. In a first embodiment, the fastener 101 can then be placed in a semi-permanent or permanent state. In the permanent state, adjustment is no longer possible. In a semi-permanent state, the fastener 101 can be manipulated to adjust the pull force, wherein the fastener 101, indicator line 110, and scale 111 are utilized to ensure an accurate and adjustable pull force for a coupled trigger 102.

The scale indicators 111 can also be used as a reference based upon the spring weights used by the one or more springs within the adjustment aperture 103. For instance, the scale can linearly start from 0 and go to 5, the spring(s) used within the aperture can have a prescribed spring weight of 3 lbs. The adjustment scale can then indicate how much additional spring weight is added to the 3 lb spring. Alternatively, a 4 lb spring could be used and the reference numbers could indicate the amount of additional weight resistance added when adjusting the fastener to a prescribed scale indicator marking. It should be understood that any suitable spring weight can be used. Alternatively, the scale indicators 111 can be pre-determined to correspond to a calibrated trigger assembly 10.

Figure 4:
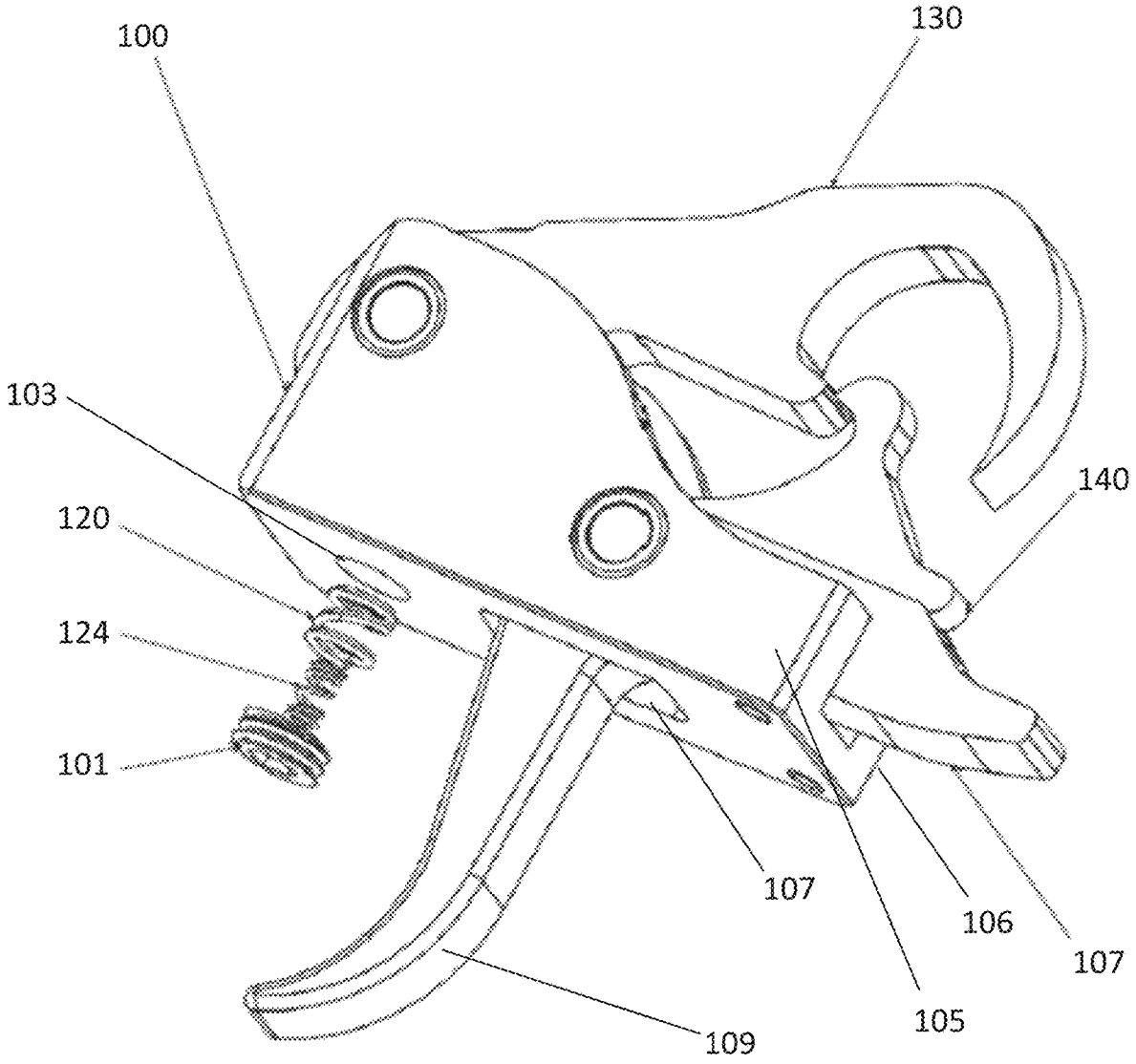
FIG. 4 is a partially exploded side isometric view of an exemplary embodiment of an improved trigger assembly apparatus according to the present disclosure.

As shown in FIGS. 4-5, a trigger assembly 10 of the present disclosure can generally include a hammer 130, a disconnect 140, a trigger 102 and a housing 100. The housing cavity can house a majority of the components within the cavity. Similarly, the housing 101 can allow for the trigger assembly to be preassembled and easily coupled into a firearm. It should be understood in some exemplary embodiments that the housing could similarly be performed as a portion of a firearm. A second portion 109 of the trigger can extend through the trigger aperture 107 located on the bottom surface 104 of the housing. The trigger 102 can be pivotable around a trigger assembly aperture 128 that can pivot around an assembly pin 129 or suitable fastener.

The first portion 108 of the trigger can have a first end 118 and a second end 119. The first end 118 can include a portion 143 such as a cavity or pocket for accepting or interfacing with a biasing means, including but not limited to a spring. In some exemplary embodiments, the portion 143 can house a disconnect biasing means 153 that can allow the disconnect to bias between a first and second position. The disconnect 140 can have a similar disconnect assembly aperture 144 that can align with the trigger assembly aperture 128. An assembly pin 129*a* can be positioned through both the trigger assembly aperture 128 and the disconnect assembly aperture 144 which can allow the disconnect 140 to bias around the axis of the assembly pin 129*a*.

The hammer 130 can include an interfacing portion 131 that can interface with the interfacing portion 141 of the disconnect upon recoil of the hammer 130. The two corresponding interfacing portions can interface or intermediately removably couple with each other after firing and or when the hammer is in a retracted or cocked position. The hammer can similarly have a hammer assembly aperture 134 that can be coupled to a firearm or the assembly 10 with an assembly pin 129*b*.

Figure 5A:
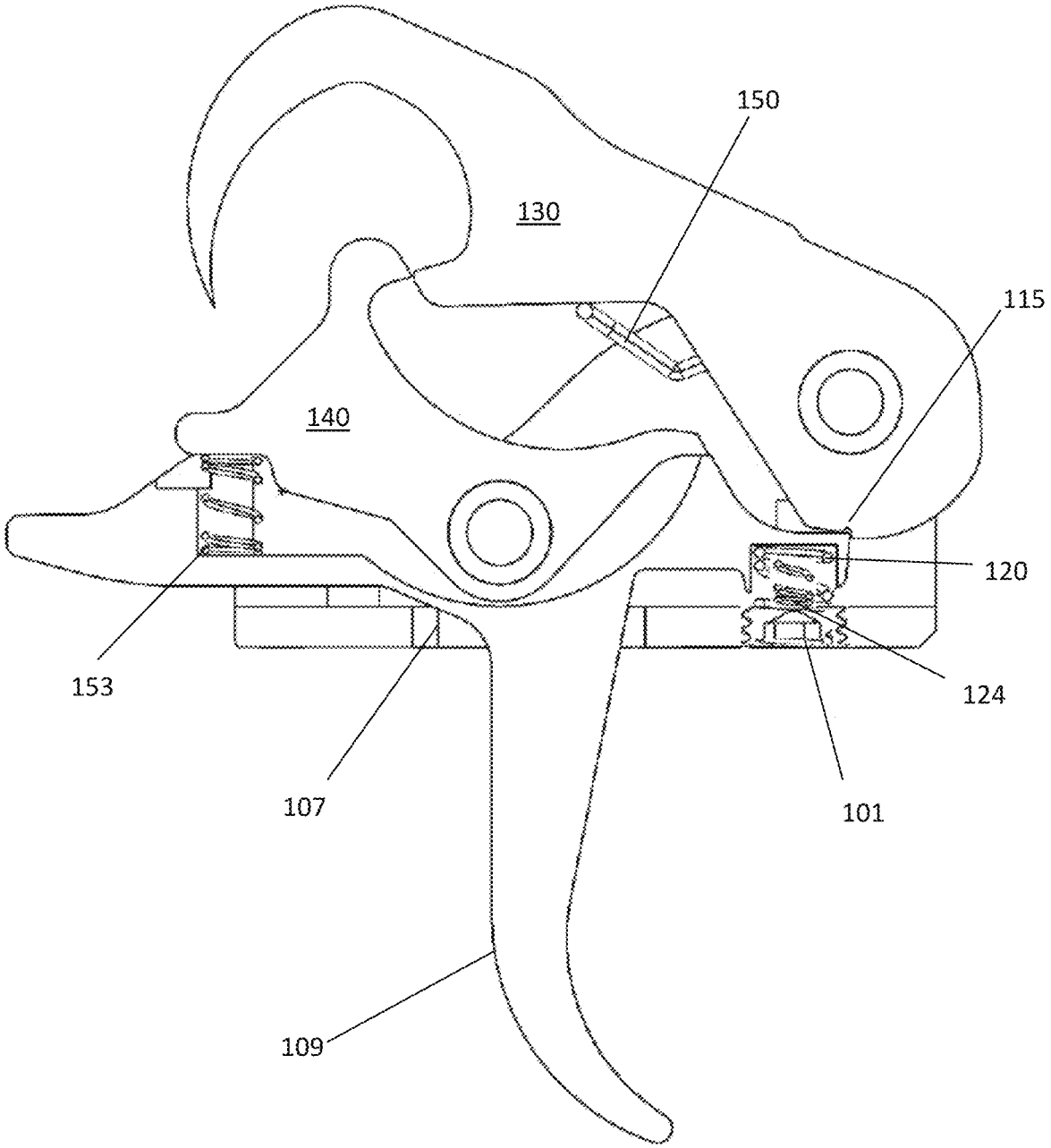
FIG. 5A is a cross-sectional view of an exemplary embodiment of an improved trigger assembly apparatus according to the present disclosure of FIG. 4.
Figure 5B:
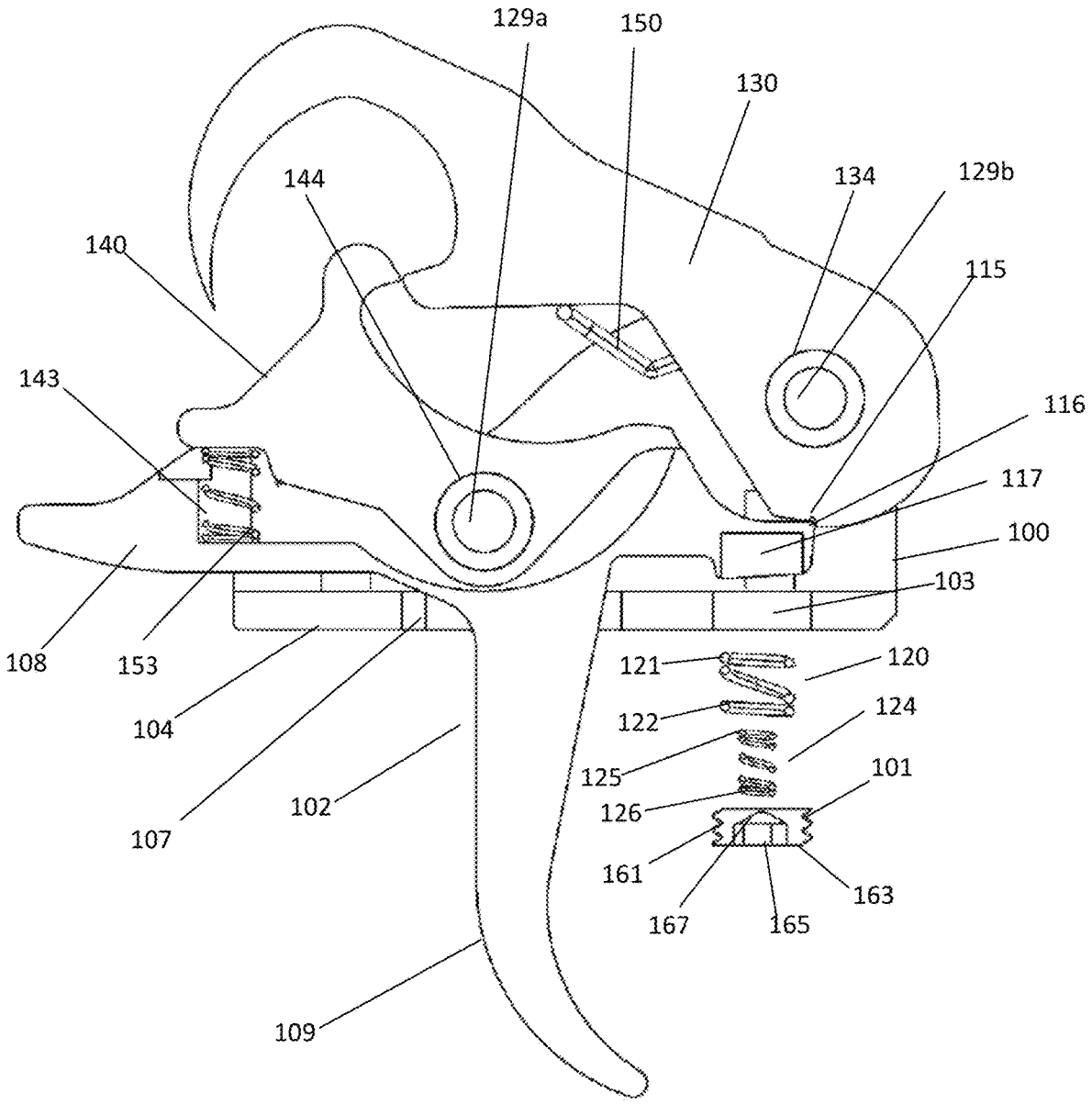
FIG. 5B is partially exploded side cross-sectional view of an exemplary embodiment of an improved trigger assembly apparatus according to the present disclosure of FIG. 5A.
Figure 6A:
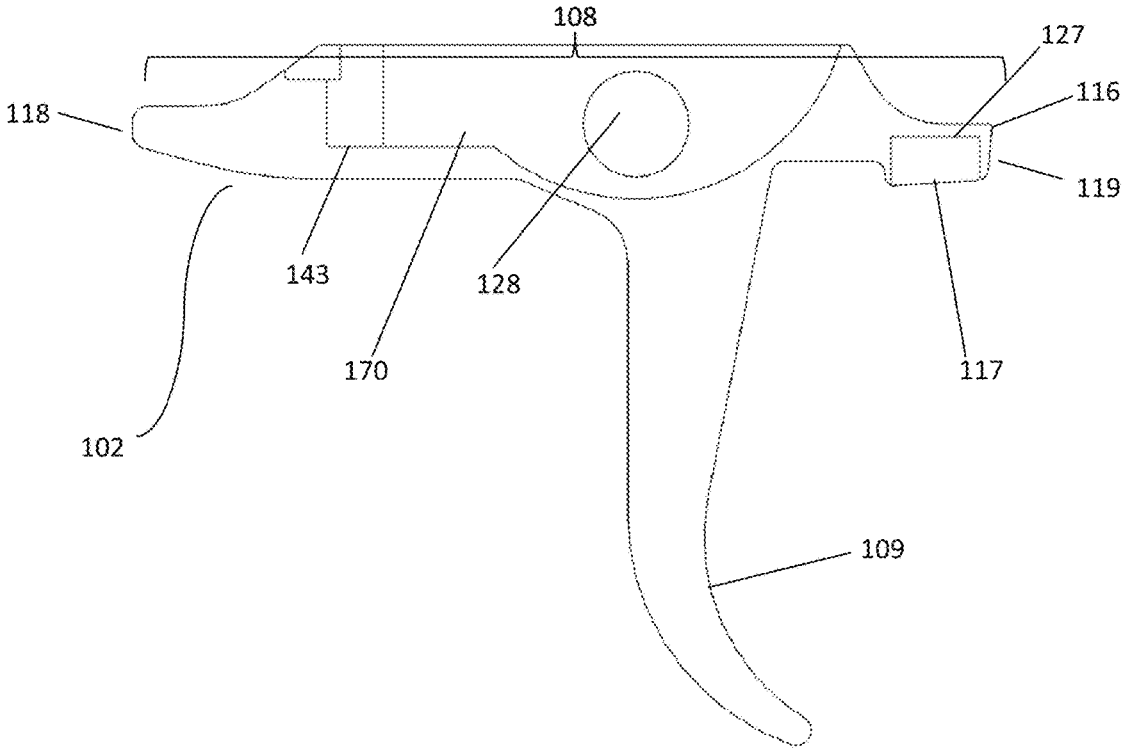
FIG. 6A is a side view of a trigger portion of an exemplary embodiment of an improved trigger assembly apparatus according to the present disclosure.
Figure 6B:
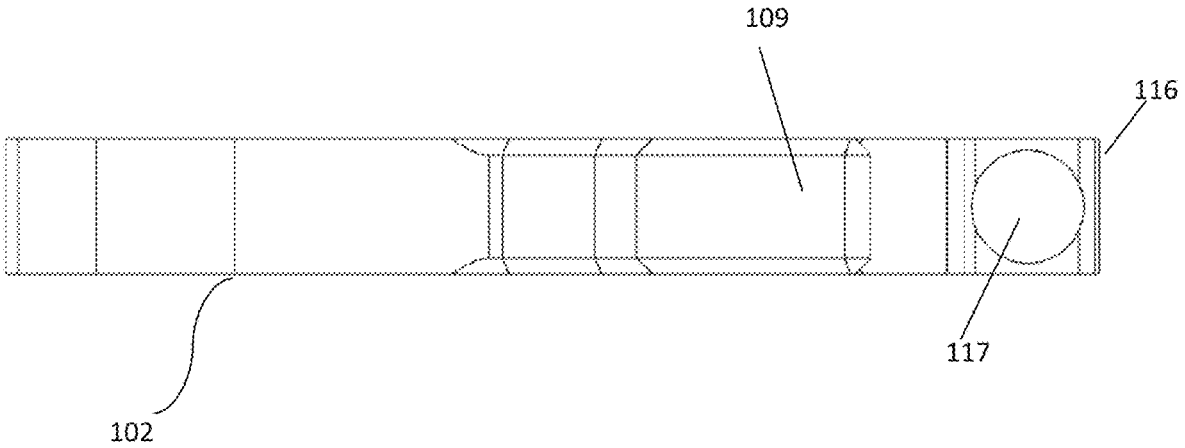
FIG. 6B is a bottom view of a trigger portion of an exemplary embodiment of an improved trigger assembly apparatus according to the present disclosure.

The hammer 130 can additionally include a cocking notch 115 that can interface with a sear engagement edge 116 of the trigger 102. The sear engagement edge 116 can be located on the second end of the first portion 108 of the trigger. In some exemplary embodiments, an adjustment cavity or interfacing portion 117 can be located at the second end 119 of the first portion 108 of the trigger 102. In some exemplary embodiments, the adjustment cavity 117 be located proximate to the sear engagement edge 116 as shown in FIGS. 5A-5B.

An adjustment cavity 117 can be positioned above the adjustment aperture 103 of the housing when the trigger 102 is positioned within the housing and the assembly 129 is provided. The adjustment cavity 117 can have a top surface and sidewall. On or more springs can interface with the top surface 127 of the cavity 117. When a user pulls against the second portion 109 of the trigger 102 the sear engagement edge 116 can disengage the cocking notch 115, which can release the hammer 130. In other exemplary embodiment, the adjustment cavity 117 can be an engagement portion configured to interface with a spring or biasing means.

In some exemplary embodiments, one or more springs can be fully or partially housed within the adjustment aperture 103 and/or the adjustment cavity 117. Alternatively, the fastener can have a cavity 161 that houses a portion of the one or more springs. In one exemplary embodiment, the adjustment cavity 117 can include a first spring or biasing means 120 that can be positioned within the adjustment cavity 117. An adjustment fastener 101 or coupling means can then be coupled to the aperture 103 to enclose the spring 120 within the aperture 103 and cavity 117. The removable fastener 101 can allow a user to easily access the one or more springs to repair or replace the springs if needed. In some exemplary embodiments, a fastener 101 can have an interior cavity 161 having a bottom surface 163 that can interface with a second end 122 of the spring, while the first end 121 of the spring interfaces with the top surface of the adjustment cavity 117.

The fastener 101 may optionally include an interior post portion 165. The interior post portion can be configured to interface with a second adjustment spring 124. The second adjustment spring can have a first end 125 and a second end 126. The first end of the second adjustment spring 124 can interface with the top surface 127 of the adjustment cavity 117 and the second end 126 of the adjustment spring 124 can interface with a top surface 167 of the interior post portion 165. In some exemplary embodiments, the top surface 167 of the post portion 165 can have a generally pointed or conical end. The conical configuration can allow to better locate the second spring having different diameters.

In some exemplary embodiments, the cavity 161 of the adjustment fastener 101 can house a portion of the one or more biasing means positioned within the adjustment aperture 117. The adjustment aperture can be moved from a first position to a second position to adjust the compression force and the pull force necessary to disengage the edge 116 from the notch 116. In some exemplary embodiments, the fastener 101 can be tightened or further moved within the aperture 103 to further compress the springs to create a greater pull force, while moving the fastener 101 to surface further from the top surface of the cavity reduces the pull force required by the trigger. The movement of the fastener 101 can be calibrated to one or more springs to allow a user to easily adjust the pull force of the trigger. In some exemplary embodiments, the adjustment aperture 103 can be positioned in front or finger portion of the trigger 102.

The first spring 120 can have a first length and a first diameter and the second spring 124 can have a second length and a second diameter. In some exemplary embodiments, the diameter of the first spring 120 can be greater than the diameter of the second spring 24. Additionally, in some exemplary embodiment the first spring 120 and second spring 124 can have the same or different lengths. The first spring 120 and second spring 124 can have any suitable compression weight or force. In some exemplary embodiments, the first spring 120 and second spring 124 can be compression springs. In one exemplary embodiment, the second spring 124 can have a longer length than the first spring 120. The post portion 165 can have a diameter. In some exemplary embodiments, the post portion 165 diameter can be less than the diameter of the first spring 120 and greater than the diameter of the second spring 124.

The one or more adjustment springs can allow for a user to alter the trigger pull rate of a trigger by adjusting the adjustment fastener 101. The adjustment fastener 101 can bias the springs between one or more positions to create more or less trigger pull weight. It should be understood that any suitable number of springs can be utilized. In one exemplary embodiment, the trigger assembly 10 of the present disclosure can include a trigger 102 having a first portion 108 that can generally be located within the cavity of the housing and a second portion 109.

The second portion 109 can be the trigger bow or finger pull to allow a user to engage the trigger 102. The trigger bow 109 can generally extend out of the aperture 107 of the housing 102. The first portion 108 can have a first end 118 and a second end 119 and can be formed generally perpendicular to the second portion 109 of the trigger 102. The first end 118 can have a first portion 143 to accept or interface with a disconnect biasing means 153. The second end 119 can have a second portion 117 that can be an adjustment cavity to house one or more trigger springs that can be used to adjust or set the trigger pull weight of the trigger assembly 10. In some exemplary embodiments, the cavity 117 can generally be positioned proximate to trigger sear edge 116. In some exemplary embodiments, the trigger 102 can have a recessed portion 170 that can accept a portion of the disconnect 140. The disconnect 170 can be at least partially positioned within the recessed portion and can be pivotable around the assembly pin 129*a*. The biasing means 153 can bias the disconnector 140 between one or more positions around the assembly pin 129*a*. The biasing means can interface with a bottom surface of the disconnector and a surface or cavity of the trigger 102 as shown in FIGS. 5A-5B.

The first biasing means 120 or spring can aid in maintaining pressure between the sear engagement edge 116 of the trigger 102 with the cocking notch 115 of the hammer 130. The spring can have any suitable compression weight or force. In some exemplary embodiments, the compression rate of the spring can translate to between about 2-6 lbs or between about 3.5-5.5 lbs of pull force on the trigger bow to disengage the edge 116 from the notch 115. A second spring or biasing means 124 can be included to further improve the adjustability of the trigger assembly pull weight. The second spring can further reduce the amount of weight or pull force needed to pull the trigger and disengage the edge 116 from the notch 115. The biasing means 120 can ensure that the edge 116 of the trigger remains engaged with the notch 115 until a prescribed or pre-determined pull force is exerted upon the bow 109 of the trigger 102. In some exemplary embodiments, a second spring 124 can be positioned within the interior diameter of the first spring 120.

A biasing means 120 can additionally allow the trigger 102 to pivot around the axis of the assembly pin 129*a*. When the trigger bow 109 is moved or pulled and the trigger pull force is exceeded, the one or more springs will compress and disengage the sear engagement edge 116 from the cocking notch 15 release the hammer 130 that is under tension from the hammer spring 150. The adjustment fastener 101 as provided can further adjust the prescribed pull force to cause the hammer 130 to be released. In some exemplary embodiments, the adjustment fastener 101 can be a locking fastener that can allow for the fastener to be adjusted up and down and then locked in the desire position within the adjustment aperture 103. In some exemplary embodiments the hammer 130 moves in a direction opposite of the direction of the trigger bow as it is pulled.

While the invention has been described above in terms of specific embodiments, it is to be understood that the invention is not limited to these disclosed embodiments. Upon reading the teachings of this disclosure many modifications and other embodiments of the invention will come to mind of those skilled in the art to which this invention pertains, and which are intended to be and are covered by both this disclosure and the appended claims. It is indeed intended that the scope of the invention should be determined by proper interpretation and construction of the appended claims and their legal equivalents, as understood by those of skill in the art relying upon the disclosure in this specification and the attached drawings.

What is claimed is:

1. An improved trigger assembly apparatus comprising:

a housing portion, the housing portion configured for receipt into a firearm, wherein the housing portion has a first sidewall, a second sidewall, and a bottom wall, wherein a cavity is formed within the first sidewall, second sidewall, and bottom wall, wherein the bottom wall includes a first aperture and a second aperture, wherein the second aperture is configured to accept an adjustment fastener;

a trigger, wherein a first portion of the trigger is at least partially positioned and received within the cavity of the housing and a second portion of the trigger portion is configured to extend out of the first aperture on the bottom wall of the housing portion, the trigger is pivotably coupled the housing, wherein the first portion includes an adjustment cavity having an interior sidewall and top surface;

a first spring having a diameter and a length, wherein the first spring is housed within the adjustment cavity of the trigger, wherein the adjustment fastener is configured to adjust the compressive force exerted onto the adjustment cavity of the trigger, wherein the adjustment fastener can be moved from a first position to a second position, wherein the first position exerts a first compressive force against the adjustment cavity and the second position exerts a second compressive force against the adjustment cavity of the trigger, wherein the first compressive force and second compressive force correlate to a pull force of the trigger, and wherein the adjustment fastener includes an indicator line.

2. The trigger assembly of claim 1, wherein the housing includes an adjustment scale, the adjustment scale positioned adjacent to the adjustment aperture and indicate a given tension of the trigger spring as it relates to the pull force of the trigger.

3. The trigger assembly of claim 2, wherein the fastener includes a pitch, the pitch selected to cooperate with trigger spring rate.

4. The trigger assembly of claim 3, wherein the scale has a precision of 0.2 micrometers.

5. The trigger assembly of claim 1, wherein the trigger pull force can be adjusted within an accuracy range of 1 oz. of pull force weight.

6. The trigger assembly of claim 1, wherein the adjustment fastener includes an interior cavity, wherein a portion of the first spring is housed within the interior cavity of the adjustment fastener.

7. The trigger assembly of claim 6, wherein the diameter of the interior post member is less than the diameter of the first spring.

8. The trigger assembly of claim 7, further comprising a second spring having a first end, second, a diameter and a length.

9. The trigger assembly of claim 8, wherein the diameter of the second spring is less than the diameter of the interior post member, wherein the first end of the second spring interface with the top surface of the interior post member and the second end interfaces with the top surface of the adjustment cavity.

10. The trigger assembly of claim 9, wherein the top surface of the interior post member is conical.

11. The trigger assembly of claim 10, wherein the first spring has a first spring rate and the second spring has a second spring rate.

12. The trigger assembly of claim 7, wherein the bottom surface around the second aperture includes a plurality of tension scale indicators markings.

13. The trigger assembly of claim 12, wherein a top surface of the adjustment fastener includes and indicator line, wherein the indicator line provides visual feedback as to the pull force based upon the correlating tension scale indicator to which the indicator is aligned.

14. The assembly of claim 13, further comprises a disconnector and a hammer, wherein the hammer includes a cocking notch configured to interface with a sear engagement edge of the trigger, wherein the sear engagement edge disengages the cocking notch when the trigger pull force is exceeded.

15. A method for adjusting the trigger pull force of a given firearm, comprising:

providing the trigger assembly having a housing and an adjustment fastener accessible on a bottom surface of the housing, wherein an adjustment spring is in contact with a portion of a trigger of the trigger assembly and exerts a first spring force against a portion of the trigger; and adjusting the spring force exerted by the adjustment spring by turning the adjustment fastener without removing the adjustment spring, wherein the housing includes a scale marked on the housing and an indicator line on the adjustment fastener to determine the trigger pull force after adjusting the spring force by turning the adjustment fastener.

16. An improved trigger assembly apparatus comprising:

a housing portion, the housing portion configured for receipt into a firearm, wherein the housing portion has a first sidewall, a second sidewall, and a bottom wall, wherein a cavity is formed within the first sidewall, second sidewall, and bottom wall, wherein the bottom wall includes a first aperture and a second aperture, wherein the second aperture is configured to accept an adjustment fastener, wherein a plurality of tension scale indicators markings are provided around the second aperture and the adjustment fastener includes an indicator line provided on a top surface of the adjustment fastener;

a trigger, wherein a first portion of the trigger is at least partially positioned and received within the cavity of the housing and a second portion of the trigger portion is configured to extend out of the first aperture on the bottom wall of the housing portion, wherein the trigger is pivotably coupled the housing, wherein the first portion includes an engagement portion;

a first spring having a first end, a second end, a diameter and a length, wherein the first end of the first spring at least partially engages the engagement portion of the trigger, wherein the adjustment fastener can be moved from a first position to exert a first compressive force onto the engagement portion of the trigger to a second position to exert a second compressive force against the engagement portion of the trigger, wherein the first compressive force and second compressive force correlate to a pull force of the trigger.

* * * * *